US006083402A

United States Patent [19]

Butler

[11] Patent Number: 6,083,402

[45] Date of Patent: Jul. 4, 2000

[54] STORMWATER DRAIN FILTER

[76] Inventor: George R. Butler, 23 Baldwin Ave., Crockett, Calif. 94525

[21] Appl. No.: 08/898,878

[22] Filed: Jul. 22, 1997

[51] Int. Cl.[7] ..... E03F 5/16

[52] U.S. Cl. ..... 210/663; 210/691; 210/747; 210/170; 210/265; 210/282

[58] Field of Search ..... 210/680, 691, 210/693, 747, 170, 242.4, 282, 924, 663, 265

[56] References Cited

U.S. PATENT DOCUMENTS

| | | | |
|---|---|---|---|
| 3,607,741 | 9/1971 | Sohnius | 210/680 |
| 4,130,489 | 12/1978 | Black | 210/242.4 |
| 4,366,067 | 12/1982 | Golding et al. | 210/924 |
| 4,659,478 | 4/1987 | Stapelfeld et al. | 210/924 |
| 5,264,134 | 11/1993 | McCamy | 210/691 |
| 5,364,535 | 11/1994 | Buckalew | 210/924 |
| 5,744,048 | 4/1998 | Stetler | 210/282 |

OTHER PUBLICATIONS

Advertising brochure from Hanson Concrete Products, Inc.

*Primary Examiner*—Ivars Cintins
*Attorney, Agent, or Firm*—Bruce & McCoy

[57] ABSTRACT

A Stormwater Drain Filter for removing sediment and liquid hydrocarbons comprised of a tank having a central outlet which flows into a sewer inlet and is surrounded by a floating boom which is hydrophobic and liquid hydrocarbon absorbent.

8 Claims, 3 Drawing Sheets

STORMWATER DRAIN FILTER

BACKGROUND OF THE INVENTION

1. Field of the Invention

The present invention relates to stormwater drain filters for sewer systems, and, more particularly, to a filter for stormwater runoff which removes sediment and liquid hydrocarbons that are suspended in the stormwater effluent.

2. Description of the Prior Art

Stormwater drain guards for sewer systems normally include simply a grate to prevent the influx of large debris. A storm sewer or drain means a sewer that carries storm or surface water, street wash, and other waters or drainage but excludes domestic wastewater or industrial wastes. Federal regulations and state standards now mandate the removal of sediment and hydrocarbons from stormwater runoff before it is released into sewer systems.

One commercially available system for achieving these results is a contaminant absorbing trough apparatus used in connection with new and existing stormwater drainage sewer inlets. The apparatus is provided with a trough area for the retention of a removable and replaceable absorbent filter material in a filter cartridge which collects petroleum pollutants or liquid hydrocarbons. It is claimed that the trough apparatus, when compared to oil/water separators, is the only known accepted alternative apparatus for removing petroleum pollutants but which may be installed at a fraction of the cost of oil/water separators with lower maintenance costs.

SUMMARY OF THE INVENTION

The present invention is a stormwater drain filter for capturing sediment and liquid hydrocarbons such as grease and oil washed into sewer system inlets, such as floor and street drains, by stormwater runoff. The filter is comprised of a water receptacle tank having a central water outflow outlet which permits the drainage of filtered stormwater therethrough at a generally equal volume flow rate around its periphery. A continuous porous floating boom is disposed in the tank closely surrounding the outlet. The boom is formed of a netting containing a floating particulate which is hydrophobic and a liquid hydrocarbon absorber whereby when the tank is recessed into the ground surrounding an inlet to a sewer system, with the tank water outflow outlet discharging into the sewer system inlet, stormwater flowing into the tank permits sediment washed thereinto therewith to precipitate to the bottom of the tank for subsequent removal, and the liquid hydrocarbons suspended in the stormwater to float to the surface thereof in the tank. When the hydrocarbons contact the boom by the outflow movement of the water in the tank toward the outlet, they are absorbed thereby and prevented from flowing through the outlet and into the sewer system inlet.

OBJECTS OF THE INVENTION

It is therefore an important object of the present invention to provide a new and novel stormwater drain filter for a sewer system inlet which captures sediment carried long in stormwater runoff.

It is another object of the present invention to provide a new and novel stormwater drain filter for a sewer system inlet for capturing liquid hydrocarbons that are suspended or floating in stormwater runoff.

It is a further object of the present invention to provide an inexpensive, light-weight, stormwater drain, retrofit filter, which can be installed in conjunction with either presently existing or new sewer system inlets.

It is still another object of the present invention to provide a stormwater drain filter for a sewer system inlet which simultaneously captures both sediment and liquid hydrocarbons carried along in stormwater runoff and which can be installed in conjunction with either presently existing or new sewer system inlets.

And it is yet a further object of the present invention to provide a new and novel method for simultaneously removing liquid hydrocarbons and sediment from stormwater runoff.

Other objects and advantages of the present invention will become apparent when the apparatus and method of the present invention are considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
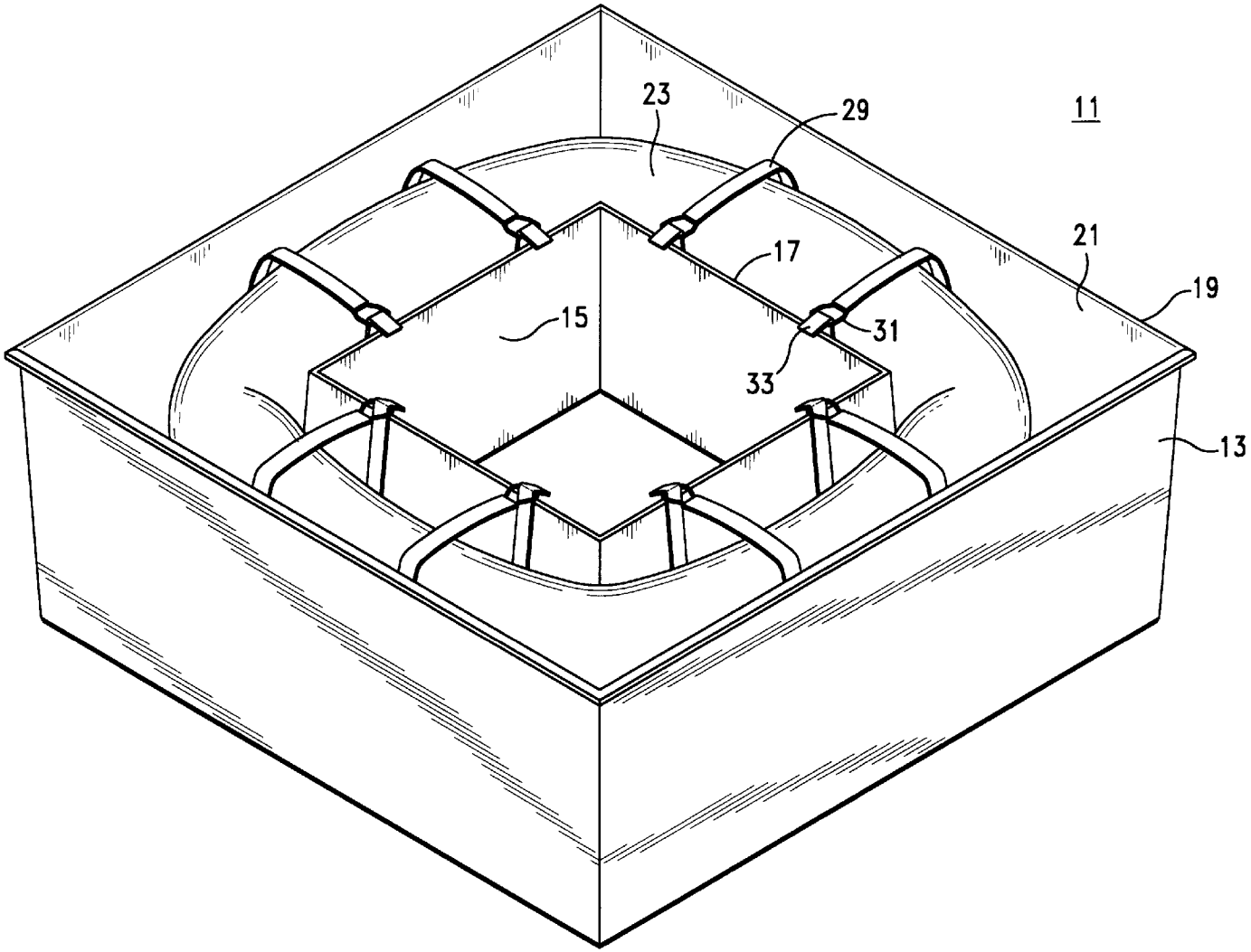
FIG. 1 is a perspective view of a stormwater drain filter of the present invention without water therein.
Figure 2:
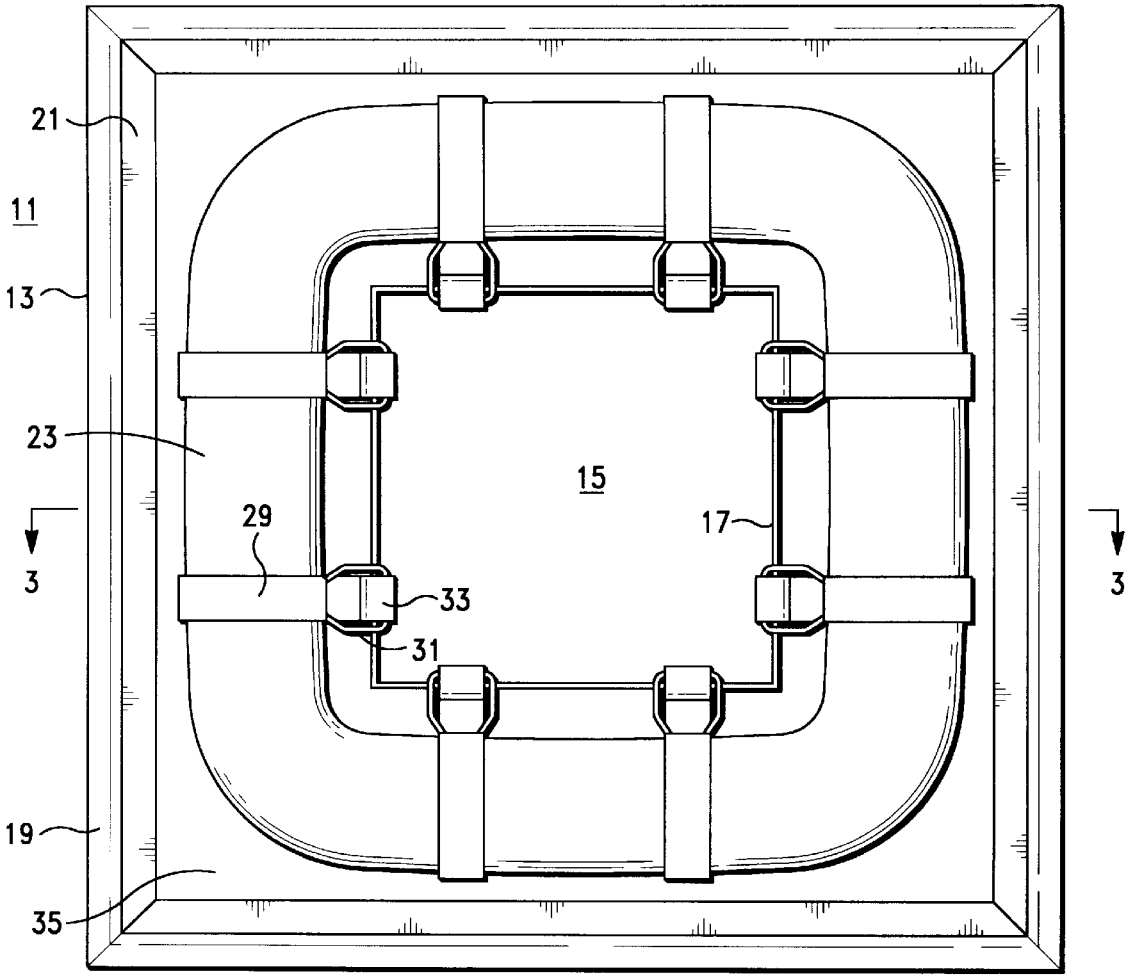
FIG. 2 is a top plan view thereof.
Figure 3:
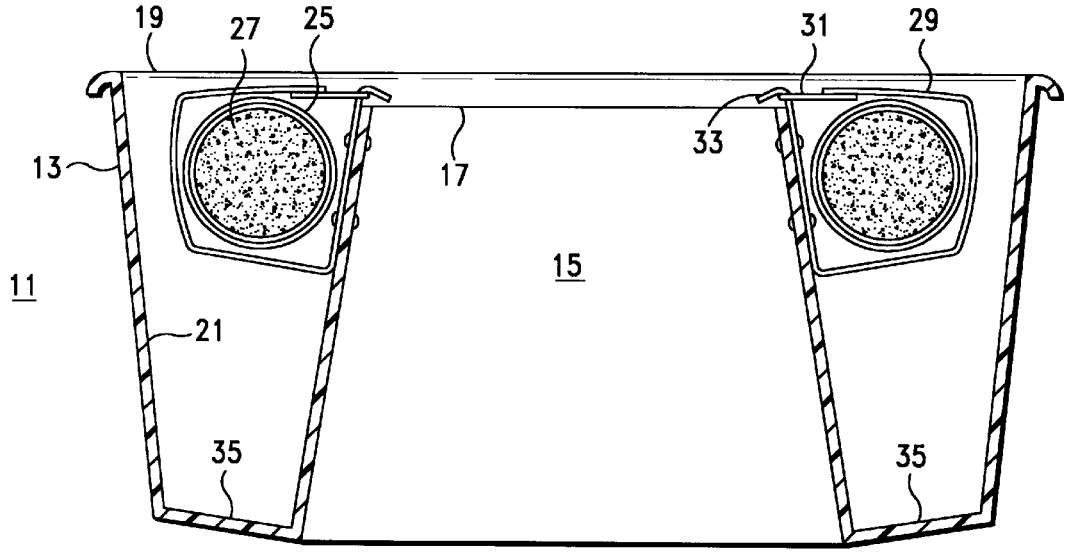
FIG. 3 is a cross-section taken along lines 3—3 of FIG. 2.
Figure 4:
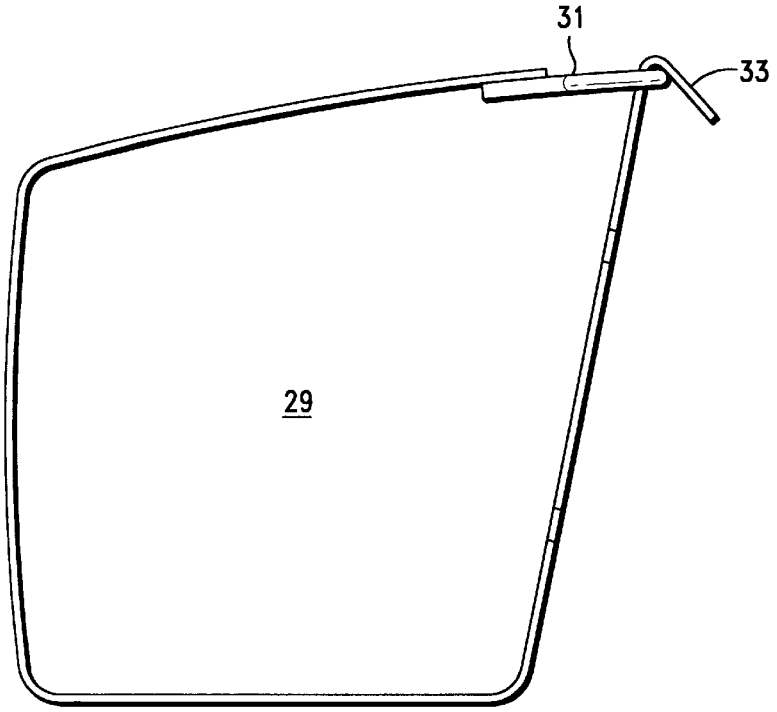
FIG. 4 is a side elevation view of a clamp as used with the present invention.
Figure 5:
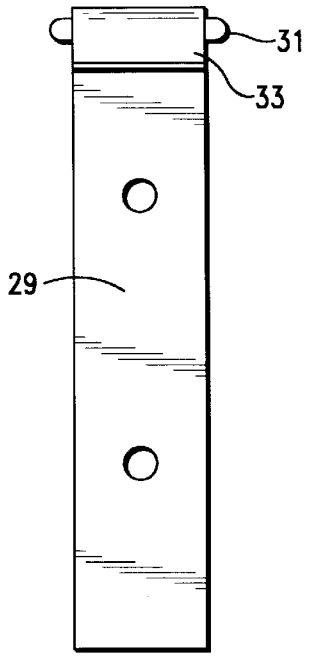
FIG. 5 is an end view thereof.
Figure 6:
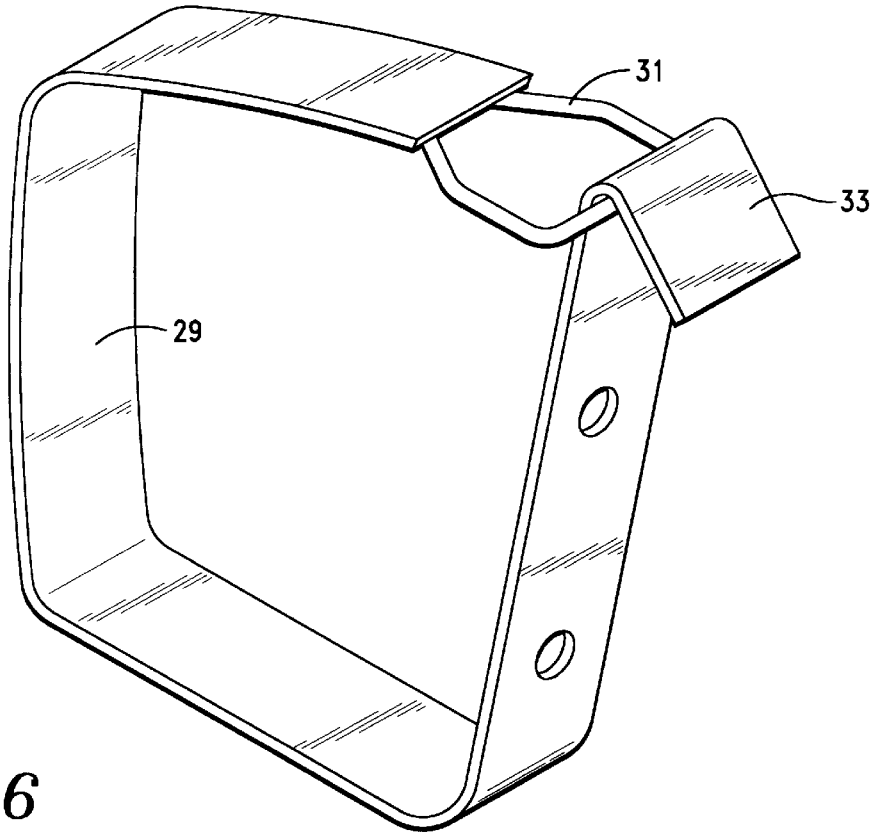
FIG. 6 is a perspective view thereof.

FIGS. 1 and 2 illustrate a stormwater drain filter 11 as contemplated by the present invention for precipitating sediment suspended in stormwater runoff and also removing liquid hydrocarbons that are suspended or floating therein.

The main element of the filter is a permanently emplaced water receptacle tank 13 for surrounding a sewer system inlet. It has a central filtered stormwater outflow outlet 15 which permits discharge of filtered water therethrough. The outlet is configured whereby the flow rate of the stormwater effluent is designed to have an equal volume flow around the periphery 17 of the outlet. This is achieved by providing an equal level height periphery for the outlet disposed sufficiently below the inlet rim 19 of the wall 21 of the water receptacle tank so that filtered water discharges through the outlet rather than backflowing over the top of the edges of the tank. However, the difference in height is not so great as to allow a large inflow of stormwater to overflow the filter element 23.

In the preferred embodiment of the invention, the receptacle tank 13 can be any configuration to conform to the sewer inlet: rectangular, round, oval, etc. As illustrated in the drawings, it is square, but it could be more generally described as rectangular. For ease of construction, the central outlet 15 is usually the same configuration as the tank but it can be different. For example, it can be a square topped circular bottomed funnel if the inlet of the sewer system is circular and the tank is rectangular. The tank is made of a cast industrial-grade plastic construction with U.V. protection to avoid the effects of corrosion and sunlight and to provide an inexpensive cost for retrofit and new construction installation.

The filter element 23 of the present invention is a continuous porous floating boom disposed in the tank 13 closely surrounding the outlet. The boom is a generally square ring formed of a tube of netting 25 containing a floating particulate 27 which is hydrophobic and a liquid hydrocarbon absorber.

The netting 25 containing the floating particulate 27 is generally annular in configuration when unrestrained but which is distortable to closely surround the configuration of the outlet 15. The netting is somewhat loose to permit the floating particulate to assume a generally oval configuration in cross-section when the boom is floating in the tank 13 surrounding the outlet. The oval configuration occurs naturally and is advantageous in that it exposes a larger portion of particulate to the water surface flow than a circular cross-section would.

The floating particulate 25 in the preferred embodiment is comprised of a compressed fiber paper tissue manufacturing byproduct having a surfactant added thereto which makes the fibers hydrophobic and liquid hydrocarbon absorbent. Other materials providing similar surface area and which function similarly to particulates which are hydrophobic and as a liquid hydrocarbon absorbent or adsorbent, of which there are numerous alternatives, would serve as a satisfactory substitute. The porosity of the boom allows the surface water in the tank to flow through the boom whereby the liquid hydrocarbons carried with it are brought into contact with the floating fiber particulate contained in the netting and absorbed thereby.

A retaining means is provided for holding the boom 23 closely adjacent to the periphery 17 of the filtered water outlet 15 in the tank 13. It captures the boom and retains it in close surrounding conforming proximity to the outlet and prevents it from floating over the edge of the outlet and into the sewer system inlet in the event that large volume flows of stormwater effluent flow through the drain filter 11.

The retaining means for the boom 23 is comprised of a multiple of releasable and deformable strap metal ring clamps 29 secured around the periphery 17 of the water outlet 15. They are preferably made of stainless steel, and each of the clamps loosely encircles the boom and can be unlocked to remove the boom and replace it with a fresh ring of particulate when the prior filter is saturated. The clamps are generally trapezoidal in configuration with a locking ring 31 which engages a hook 33 formed at the end of the clamp disposed adjacent the tank outlet periphery 17.

The locking mechanism for said releasable ring clamps 29 includes abutting locking ring 31 and hook members 33 which, when engaged, complete the formation of said ring clamp. The hook and ring members are arranged whereby, as the boom 23 floats higher in the tank 13 as a result of an increased flow of stormwater, the ring clamp locking mechanisms are tightened. When the boom segment captured by the clamp floats upward, it increases the locking action of the clamp.

When a tank 13 of the present invention is recessed into the ground surrounding an inlet to a sewer system, with the tank outflow outlet 15 discharging into the sewer system inlet, stormwater flowing into the tank permits sediment washed thereinto therewith to precipitate to the bottom of the tank for subsequent removal. The liquid hydrocarbons suspended in the stormwater float to the surface thereof in the tank and when they contact the boom 23 by the outflow movement of the water in the tank toward the outlet, they are absorbed thereby and prevented from flowing through the outlet and into the sewer system inlet.

The stormwater receiving tank 13 is provided with drain holes at the bottom so that, in a dry period, water drains out of the tank sufficiently to allow the boom 23 to fall to the bottom of the ring clamp retaining means 29 for drying in times when there is no stormwater flowing. When the boom is resting in the bottom end of the ring clamps, the upper hook 33 and loop ends 31 can be most easily disconnected by simply pushing down on the top of the clamp and inward toward the water outlet 15 whereby the locking ring is disengaged from the hook end of the clamp and the boom can easily be lifted out of its entrapment within the clamping means.

Sediment which is precipitated into the bottom of the tank 13 collects at the lower end thereof as a result of the angulated bottom 35 formed in the tank so that it can be extracted from the tank periodically by mechanical means or vacuum removal.

The present invention also includes the separate methods of removing liquid hydrocarbons and sediment from stormwater washed into sewer system inlets simultaneously. The liquid hydrocarbons are removed by surrounding the inlets to the sewer system with a floating porous boom formed of a netting containing a floating particulate which is hydrophobic and liquid hydrocarbon absorbent. The boom is restrained to a configuration closely surrounding the periphery of the inlet whereby stormwater flowing thereinto must pass through the boom. As a result, liquid hydrocarbons floating or suspended in the stormwater are captured by being absorbed into the particulate. Sediment is simultaneously removed from the stormwater along with the hydrocarbons by placing a water receptacle tank having a central outflow outlet around each of the sewer system inlets whereby sediment flowing into the tanks with the stormwater is precipitated out of the water before the filtered water discharges from the tanks into the sewer system inlets.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

I claim:

1. A stormwater drain construction for separating sediment from stormwater flowing into a sewer system inlet and for capturing liquid hydrocarbons contained in said stormwater in a filter with minimal sediment contacting the filter material during the separation process thereby minimizing filter contamination, said drain construction comprising a water receptacle tank having an inlet rim and a raised central stormwater outflow outlet with a discharge height below said inlet rim, said tank being recessed into the ground and surrounding said sewer system inlet thereby permiting the discharge of filtered water therethrough at a generally equal volume flow rate around its central periphery and precipitation of sediment into said tank around said outlet, and a continuous porous floating boom disposed in said tank closely surrounding said outlet, said boom being formed of a netting containing a floating particulate which is hydrophobic and a liquid hydrocarbon absorber whereby stormwater flowing into said tank causes sediment washed thereinto therewith to precipitate to the bottom of said tank around the outside periphery of said sewer system inlet for subsequent removal and liquid hydrocarbons suspended in said stormwater to float to the surface thereof in said tank whereby when said hydrocarbons contact said boom by the outflow movement of said stormwater in said tank toward said outlet said hydrocarbons are thereby absorbed and prevented from flowing through said outlet and into said sewer system inlet.

2. The stormwater drain of claim 1 wherein said netting is formed of a tubular construction which is distortable to closely surround the configuration of said outlet and to permit said floating particulate to assume an oval configuration when said boom is floating.

3. The stormwater drain of claim 1 including a restraining means secured to said outlet for positioning said boom and retaining it in close surrounding relation to said outlet and preventing it from floating over the edge of said outlet in the event of large stormwater flows into said drain.

4. A stormwater drain filter for a sewer system inlet comprising a water receptacle tank formed for surrounding said inlet, said having an inlet rim and a raised central stormwater outflow outlet with a discharge height below said tank inlet rim, said stormwater outlet of said tank being of generally equal level height all around its periphery and discharging into said sewer system inlet whereby sediment precipitates into said tank around said outlet out of stormwater flowing into said tank, a floating boom closely surrounding said outlet comprised of a porous tubular ring of netting containing a hydrophobic liquid hydrocarbon absorbing particulate, and retaining means holding said boom adjacent the periphery of said outlet.

5. The stormwater drain filter of claim 4 wherein the bottom of said tank is angulated to concentrate sediment precipitated into said tank from said stormwater.

6. The stormwater drain filter of claim 4 wherein said retaining means for said boom is comprised of a multiple of releasable and deformable ring clamps secured around said water tank outlet and each of which encircles said boom.

7. The stormwater drain filter of claim 6 wherein a locking mechanism for said releasable ring clamps is provided which includes abutting locking ring and hook members which when engaged complete the formation of said ring clamp, said hook and ring members being arranged whereby as said boom floats higher in said tank as a result of an increased flow of stormwater, said ring clamp locking mechanisms are tightened.

8. A method of simultaneously removing sediment and liquid hydrocarbons from stormwater washed into sewer system inlets comprising placing a water receptacle tank having a central outflow outlet around each of said sewer system inlets whereby sediment flowing into said tanks with said stormwater is precipitated therefrom into said tank around said inlet before said water discharges from said tanks by overflowing into said sewer system inlets, surrounding said inlets with a floating porous boom formed of netting containing a floating particulate which is hydrophobic and liquid hydrocarbon absorbent, and restraining said boom to a configuration closely surrounding the periphery of said inlets whereby stormwater overflowing thereinto must pass through said boom surrounding said inlets whereby liquid hydrocarbons floating or suspended in said stormwater are captured by being absorbed into said particulate.

* * * * *